US009790937B2

(12) United States Patent
Morrison

(10) Patent No.: US 9,790,937 B2
(45) Date of Patent: Oct. 17, 2017

(54) LOW RESTRICTION RESONATOR WITH ADJUSTABLE FREQUENCY CHARACTERISTICS FOR USE IN COMPRESSOR NEBULIZER SYSTEMS

(75) Inventor: Mark Steven Morrison, Basking Ridge, NJ (US)

(73) Assignee: KONINKLIJKE PHILIPS N.V., Eindhoven (NL)

( * ) Notice: Subject to any disclaimer, the term of this patent is extended or adjusted under 35 U.S.C. 154(b) by 856 days.

(21) Appl. No.: 13/384,283

(22) PCT Filed: Jun. 16, 2010

(86) PCT No.: PCT/IB2010/052717

§ 371 (c)(1),
(2), (4) Date: Jan. 16, 2012

(87) PCT Pub. No.: WO2011/015954

PCT Pub. Date: Feb. 10, 2011

(65) Prior Publication Data

US 2012/0121441 A1 May 17, 2012

Related U.S. Application Data

(60) Provisional application No. 61/230,762, filed on Aug. 3, 2009.

(51) Int. Cl.
*F04B 39/00* (2006.01)

(52) U.S. Cl.
CPC ..... *F04B 39/0066* (2013.01)

(58) Field of Classification Search
CPC ..... F04B 39/0066; F04B 39/0027; F04B 39/0088; F04B 2203/0404; F04B 2205/12;

(Continued)

(56) References Cited

U.S. PATENT DOCUMENTS 2,570,241 A * 10/1951 Hutchinson ..... 417/540
2,750,915 A * 6/1956 Carlberg ..... A47L 9/19 116/112

(Continued)

FOREIGN PATENT DOCUMENTS

DE 4305333 C1 7/1994
DE 20321335 U1 1/2007

(Continued)

OTHER PUBLICATIONS

Anomymous, "Noise Reduction with a Helmholtz Resonator at a Compressor in a Full Cell Vehicle", Research Disclosure, pp. 1-2, RD 506077, Jun. 2006.

*Primary Examiner* — Devon Kramer
*Assistant Examiner* — Kenneth J Hansen
(74) *Attorney, Agent, or Firm* — Michael W. Haas

(57) ABSTRACT

A compressor system and a method of reducing noise in the compressor system. The compressor system includes an inlet port configured to receive gas, an outlet port configured to output compressed gas, and a compressor pump connected to the inlet port via a pneumatic line and to the outlet port. The compressor pump is configured to pressurize gas input through the inlet port and to output a compressed gas through the outlet port. The compressor pump generates noise during operation of the compressor pump. The compressor system further comprises a side-branch resonator having a housing forming a cavity and an elongated member connected to the housing. The elongated member is pneumatically connected to the pneumatic line between the inlet port and the compressor pump. The side-branch resonator is configured to substantially reduce noise generated by the compressor pump, to monitor an operation of the compressor pump, or both.

24 Claims, 9 Drawing Sheets

(58) Field of Classification Search
CPC .... F04B 11/00; F04B 11/0008; F04B 11/0016
USPC ..... 417/312
See application file for complete search history.

(56) References Cited

U.S. PATENT DOCUMENTS

| | | | | |
|---|---|---|---|---|
| 3,864,064 | A * | 2/1975 | Gannaway | 417/312 |
| 3,866,001 | A * | 2/1975 | Kleinschmidt et al. | 181/285 |
| 4,239,461 | A | 12/1980 | Elson | |
| 4,359,962 | A * | 11/1982 | Olsson et al. | 116/137 R |
| 4,546,733 | A * | 10/1985 | Fukami et al. | 123/184.57 |
| 4,941,545 | A | 7/1990 | Wilcox et al. | |
| 5,005,511 | A * | 4/1991 | Olsson | 116/137 R |
| 5,062,419 | A | 11/1991 | Rider | |
| 5,446,790 | A | 8/1995 | Tanaka | |
| 6,386,317 | B1 | 5/2002 | Morohoshi et al. | |
| 6,644,118 | B2 * | 11/2003 | Kaduchak et al. | 73/570.5 |
| 6,681,767 | B1 | 1/2004 | Patton et al. | |
| 6,698,390 | B1 * | 3/2004 | Kostun | F02M 35/1222 123/184.57 |
| 6,758,304 | B1 * | 7/2004 | McLean | 181/206 |
| 6,759,304 | B2 | 7/2004 | Coronel et al. | |
| 7,055,484 | B2 * | 6/2006 | Marks | F02B 27/0294 123/184.56 |
| 7,077,093 | B2 * | 7/2006 | Koelmel et al. | 123/184.57 |
| 7,136,781 | B2 * | 11/2006 | Saito et al. | 702/188 |
| 7,588,424 | B2 * | 9/2009 | Mrzyglod | 417/312 |
| 2003/0091198 | A1 | 5/2003 | Vanderveen | |
| 2003/0152239 | A1 * | 8/2003 | Graefenstein | G10K 11/1788 381/71.5 |
| 2005/0166921 | A1 * | 8/2005 | DeVries et al. | 128/204.21 |
| 2006/0048823 | A1 * | 3/2006 | Hagano | 137/557 |
| 2006/0144396 | A1 * | 7/2006 | DeVries et al. | 128/204.21 |
| 2008/0257346 | A1 | 10/2008 | Lathrop et al. | |

FOREIGN PATENT DOCUMENTS

| | | | |
|---|---|---|---|
| EP | 0649982 | A1 | 4/1995 |
| EP | 1381025 | A2 | 1/2004 |
| JP | 09195936 | A | 7/1997 |
| JP | 10245203 | A | 9/1998 |
| JP | 2000186527 | A | 7/2000 |
| JP | 2003235982 | A | 8/2003 |
| JP | 2004069173 | A | 3/2004 |
| JP | 2005264886 | A | 9/2005 |
| WO | WO9419596 | A1 | 9/1994 |

* cited by examiner

Pressure = 10 psi

Pressure = 4 psi

LOW RESTRICTION RESONATOR WITH ADJUSTABLE FREQUENCY CHARACTERISTICS FOR USE IN COMPRESSOR NEBULIZER SYSTEMS

The present invention pertains to a method and apparatus for reducing noise in a compressor system.

Nebulizers are devices used to administer medication in the form of a mist that is inhaled into the patients lungs. Generally, nebulizers utilize compressed air for vaporizing the medication. The compressed air is generated using a compressor system. During operation, the compressor system also generates undesirable noise. Some conventional compressor systems use in-line mufflers to reduce noise.

FIG. 1 is a pneumatic schematic block diagram of a conventional compressor system using a conventional in-line muffler. The compressor system 10 includes a compressor pump 11 having an inlet or intake port 12 and an outlet or output port 14. The intake port 12 is connected to an intake filter 16. Air is drawn through the intake port 12 after passing through the filter 16 to remove impurities such as particulates present in the air. The output port 14 can be connected to various types of nebulizers (not shown) such as a mouthpiece type nebulizer, a face mask-type nebulizer, etc. The output port 14 outputs air in the form of compressed or pressurized air compressed by the compressor pump 11. The compressed air is used to vaporize the medication in the nebulizer (not shown). An in-line muffler 18 of the conventional type is disposed between the compressor pump 11 and the filter 16. The conventional muffler 18 has a housing 19. The housing 19 has an inlet 18A and outlet 18B provided in housing 19 of the muffler 18. Air enters the muffler housing 19 through inlet 18A and exits the muffler housing 19 though outlet 18B. The muffler 18 is connected through inlet 18A to the intake port 12 using tubing or pneumatic line 13A and connected through outlet 18B to the pump 11 using tubing or pneumatic line 13B. The muffler 18 is located on the intake side of the pump 11. This is because most of the noise generated by the compressor system 10 in normal use escapes from the intake side.

The conventional in-line muffler 18 has a series of internal baffles 18C that redirect sound, as well as the main flow of air, in such a way that air can escape but the noise is dissipated within the muffler housing 19. In the conventional muffler 18 air enters on one side through inlet 18A, reverses direction two times, and then finally exits the opposite side through outlet 18B. It should be noted that pump noise travels in the opposite direction to the air flow, entering on the pump side of the muffler 18, i.e., entering through outlet 18B and exiting on the filter side, i.e., exiting through inlet 18A. Although the baffles 18C interfere with sound propagation by eliminating a direct path from one end of the muffler 18 (i.e., outlet 18B) to the other end of the muffler 18 (i.e., inlet 18A), it has been observed that airflow is sometimes reduced when using this type of muffler. In such mufflers, the baffles 18C can present a restriction to air flow or in certain circumstances can create turbulence, which has an effect on overall compressor performance. Furthermore, conventional in-line muffler 18 is quite often designed for a particular compressor pump 11 and may affect compressor performance and even may not work as well on other compressors, or even the same compressor using a different handset or nebulizer.

The present invention addresses various issues relating to the above including, among other things, substantially attenuating, reducing or eliminating undesirable noise generated in a compressor system without substantially obstructing air flow and thus affecting compressor performance.

One aspect of the present invention provides a compressor system that includes an inlet port configured to receive gas, an outlet port configured to output compressed gas, and a compressor pump connected to the inlet port via a pneumatic line and to the outlet port. The compressor pump is configured to pressurize gas input through the inlet port and to output a compressed gas through the outlet port. The compressor pump generates noise during operation of the compressor pump. The compressor system further comprises a side-branch resonator having a housing forming a cavity and an elongated member connected to the housing. The elongated member is pneumatically connected to the pneumatic line between the inlet port and the compressor pump. The side-branch resonator is configured to substantially reduce noise generated by the compressor pump.

Another aspect of the present invention provides a method of reducing noise in a compressor system by disposing a side-branch resonator in the compressor system, the side-branch resonator having a housing forming a cavity and an elongated member connected to the housing; connecting pneumatically the elongated member to a pneumatic line linking between an inlet port of the compressor system and a compressor pump of the compressor system; and tuning a frequency range of the side-branch resonator so as to substantially reduce noise generated by the compressor pump.

These and other objects, features, and characteristics of the present invention, as well as the methods of operation and functions of the related elements of structure and the combination of parts and economies of manufacture, will become more apparent upon consideration of the following description and the appended claims with reference to the accompanying drawings, all of which form a part of this specification, wherein like reference numerals designate corresponding parts in the various figures. It is to be expressly understood, however, that the drawings are for the purpose of illustration and description only and are not intended as a definition of the limits of the invention. As used in the specification and in the claims, the singular form of "a", "an", and "the" include plural referents unless the context clearly dictates otherwise.

Figure 2A:
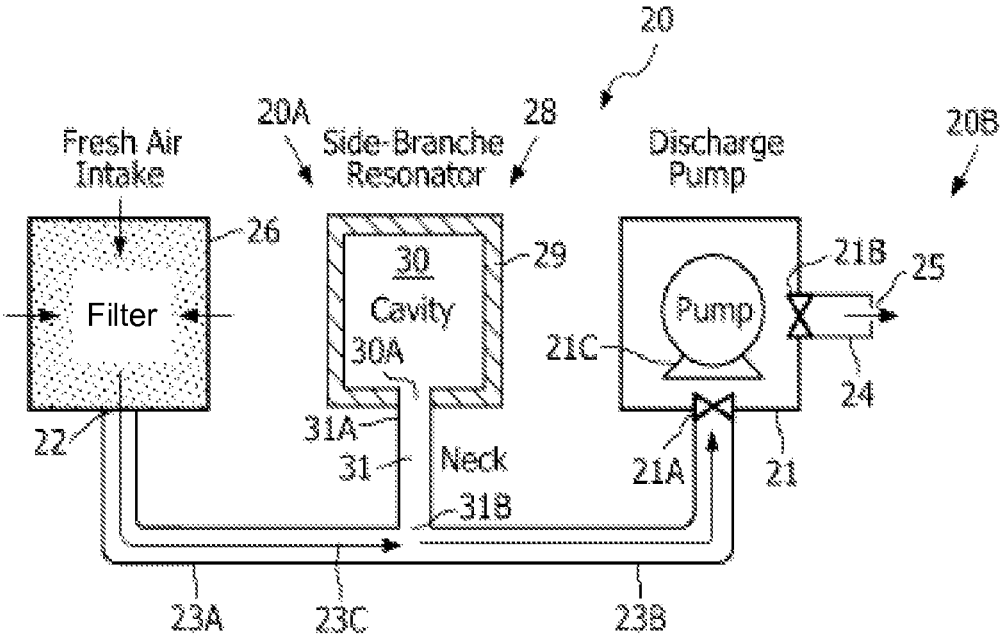
FIG. 2A is a pneumatic schematic block diagram of a compressor system using a side-branch muffler (resonator), according to an embodiment of the present invention.

FIG. 2A is pneumatic schematic block diagram of a compressor system 20, according to an embodiment of the present invention. The compressor system 20 includes a compressor pump 21 having an inlet or intake port 22 and an outlet or output port 24. The intake port 22 is connected to an intake filter 26. Air or other gas is drawn through the intake port 22 after passing through the filter 26 to remove possible impurities such as particulates present in the air or gas. The output port 24 can be connected to various types of nebulizers (not shown) such as a mouthpiece type nebulizer, a face mask-type nebulizer, etc. The output port 24 outputs air in the form of compressed air compressed by the compressor pump 21. The compressed air is used to vaporize the medication in the nebulizer (not shown). A muffler (or resonator) 28 is disposed between the compressor pump 21 and the intake port 22. The pump 21 is connected to the inlet port 22 through tubing or pneumatic line 23A, 23B. The pump 21 draws air or gas via the tubing 23A, 23B through the intake port 22 and outputs compressed air or compressed gas through output port 24.

The muffler 28 has a housing 29 defining a cavity 30. The muffler 28 also includes an elongated member or neck 31. One end 31A of neck 31 is connected to opening 30A provided in the housing 30. Another end 31B is connected to the tubing 23A, 23B via a connector, such as a T-connector, for example. In this embodiment, the muffler 28 is connected as a side-branch resonator. The noise is blocked by the presence of the cavity 30 while the flow of air through the tubing 23A, 23B is relatively unimpeded.

The muffler 28 can be seen as a Helmholtz resonator which is a pneumatic tuned circuit that reacts to a range of frequencies at the point where the neck 31 meets the main flow channel 23A, 23B. When air or gas is forced into the cavity 30, the pressure inside the cavity 30 increases. Once the external force that forces the air/gas into the cavity 30 disappears, the higher-pressure of air or gas inside the cavity will flow out. The surge of air or gas flowing out of the cavity 30 will tend to over-compensate, due to the inertia of the air or gas in the neck 31. As a result, the internal pressure in the cavity 30 will be slightly lower than the external pressure, causing air to be drawn back in. This process repeats with the magnitude of the pressure changes decreasing each time.

The operation is similar to that of a spring mass system, with the gases compressed within the cavity 30 providing the spring and the volume of air within the neck 31 providing the mass. A longer neck would make for a larger mass, and vice-versa. At the resonant frequency, the mass of air within the neck moves in and out of the cavity with maximum amplitude, alternately compressing and rarefying the air/gas within the cavity. According to resonator theory, and ignoring viscosity losses, all the energy absorbed by the resonator during certain parts of the cycle is returned to the main channel at other parts of the cycle, with much of the sound energy being redirected back toward its source (in this case the pump). The resulting effect is to block noises in a range of frequencies from propagating past the point where the resonator connects to the main channel. Frequencies well above and below the resonant frequency are not affected. For example, a resonator tuned to roughly 6.5 kHz has proven effective in reducing audible noises associated with the pump. The resonant frequency of this type resonator depends mainly on the volume of the cavity and the length and width (e.g., cross-sectional area) of the neck. The resonant frequency f can be calculated using the following formula.

$$f = \frac{v}{2\pi}\sqrt{\frac{A}{V \cdot L}}, \tag{1}$$

where v is the velocity of sound in the air or gas, A is the cross-sectional area of the neck, V is the volume of the cavity, and L is the length of the neck.

From the above formula, one can see that the resonant frequency f can be selected by changing the volume V of the cavity, the cross-sectional area A of the neck (e.g., interior diameter of the neck) or the length L of the neck. For example, in one embodiment, by constructing the neck partly out of tubing, it might be possible to adjust the resonator frequency simply by using different lengths of such tubing. Alternatively or in addition, in another embodiment, the cross-sectional dimension (e.g., diameter) of the tubing can be increased or reduced by inserting or removing concentrically arranged tubes. These designs are clearly more adapted to be frequency tuned than the conventional fixed in-line muffler design used in a conventional compressor system.

In addition to the ability of tuning the resonance frequency to a range of frequencies by adjusting any of the above identified parameters, the range of frequencies this device works over can be increased by disposing a sound absorbent material, such as sound filter media, into the cavity 30. One benefit in increasing the bandwidth or range of frequencies is the ability to accommodate the full range of sound frequencies emitted by various compressors. For instance, one resonator muffler may work well at one pump speed but can be less effective at another pump speed. Since pump speed can vary from compressor unit to compressor unit and can also vary depending on the type of nebulizer that is used, the frequency of the noise level may be different depending on the pump speed. As a result, the use of a wide bandwidth muffler resonator can provide noise attenuation at various pump speeds. The compressor units can then sound substantially the same regardless of the nebulizer used and/or the type of compressor used.

Figure 1:
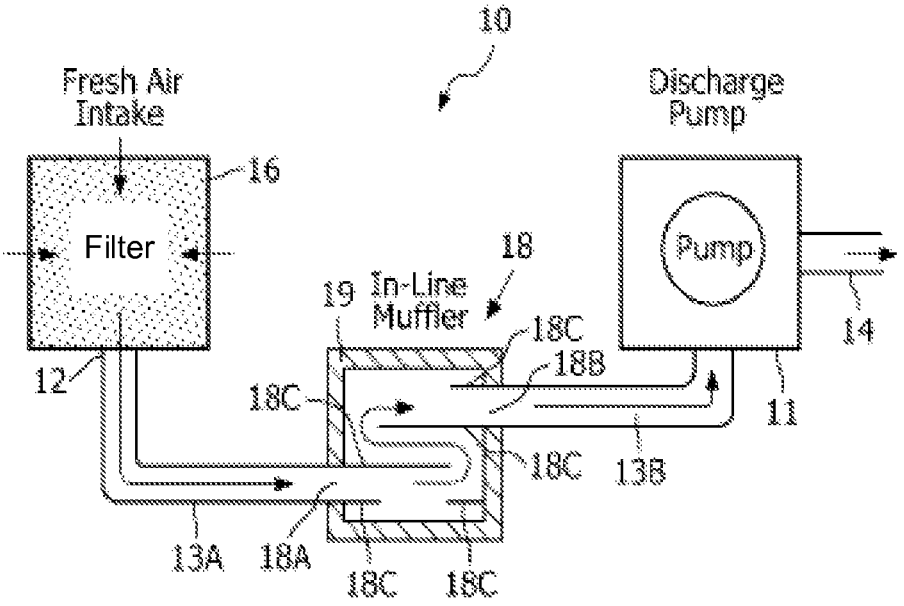
FIG. 1 (BACKGROUND ART)
FIG. 1 is a pneumatic schematic block diagram of a conventional compressor system using a conventional in-line muffler.

Furthermore, by positioning the muffler (resonator) 28 in a side-branch configuration, as shown in FIG. 2, the flow of air through the tubing 23A, 23B is substantially unimpeded or unobstructed. As a result the flow of air or gas is enhanced in comparison to conventional compressor systems using a conventional in-line muffler, as shown in FIG. 1. By improving air flow, this could lead, for example, to the use of lower power pumps that provide lower air or gas flux than pumps used in conventional compressor systems which require higher air flux to overcome the obstruction in air flow by the in-line muffler. By using lower power pumps, the cost of the overall compressor system and the energy consumption during operation of the compressor system can be reduced.

The muffler 28 is described in the above paragraphs as being used in a compressor nebulizer system to reduce undesirable compressor pump noise while minimizing effects on overall air flow. However, as it can be appreciated, the muffler 28 can also be used in any type of compressor device, including but not limited to, compressors used in oxygen concentrators, Continuous Positive Airway Pressure (CPAP) devices, ventilators, or in any compressed air/gas application where the primary source of noise is generated on the intake (suction) side of the device.

Figure 2B:
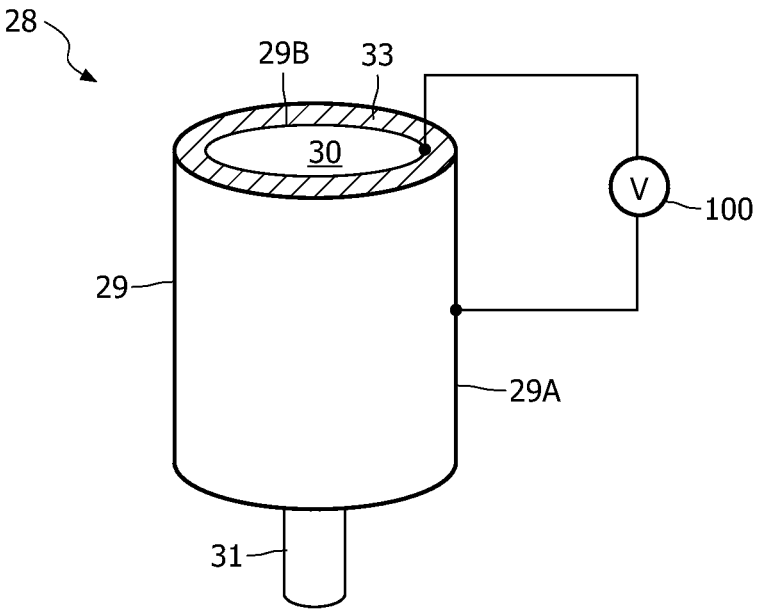
FIG. 2B depicts a schematic representation of a PZT cylinder used to form a cavity of the resonator depicted in FIG. 2A.

In one embodiment, a cylindrical piezoelectric material such as lead zirconate titanate (PZT) or PZT-based compounds is used to form the cavity 30 of the muffler or resonator 28. FIG. 2B depicts a schematic representation of a PZT cylinder used to form the cavity 30 of the resonator 28. The PZT cylinder 29 has PZT material 33 which is disposed between two concentric cylindrical electrodes 29A and 29B. A detailed description of an example of a PZT cylinder can be found in U.S. Pat. No. 6,644,118 entitled "Cylindrical Acoustic Levitator/Concentrator Having Non-Circular Cross-Section," the content of which is incorporated herein in its entirety by reference. By using a PZT cylinder 29, wires can be attached to the electrodes (e.g., silver electrodes) 29A and 29B of the cylinder 29 to observe the voltage output by the PZT cylinder 29 during operation using a voltage measuring device 100, such as an oscilloscope, for example. This allows monitoring the resonance performance during operation of the muffler 28. As will be described further in detail in the following paragraphs, the opening and/or closing of intake valve 21A and discharge valve 21B in the compressor pump 21 can also monitored using the PZT resonator 29. Indeed, by using a PZT resonator, it is possible to identify the opening and/or closing of the intake and discharge valves in the compressor pump 21 and monitor the effects of discharge pressure or load on the intake and discharge valves. This can provide the manufacturer of the pump 21 with a diagnostic tool which can be also useful in monitoring various wear mechanisms within the pump 21 such as, but not limited to, wear of the motor 21C, wear of the intake valve 21A and discharge valve 21B, etc.

Figure 3:
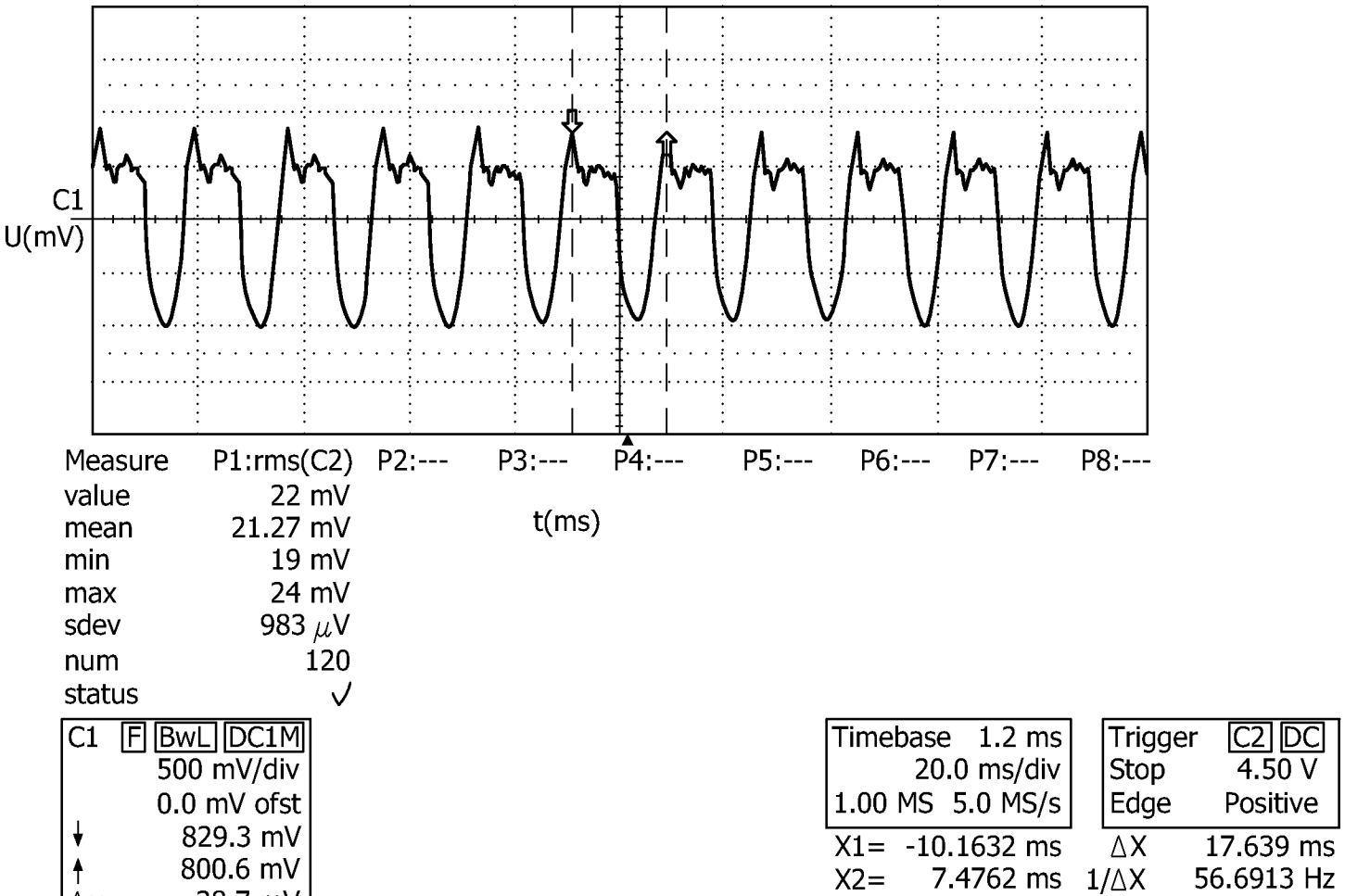
FIG. 3 is a plot of an electrical signal response of a PZT acoustic resonator when installed on the intake side of the compressor system depicted in FIG. 2 using one type of nebulizer placed on the discharge side.

FIG. 3 is a plot of an electrical signal response of the PZT acoustic resonator 28 when installed on the intake side 20A of the compressor system 20 (as depicted in FIG. 2) using one type of nebulizer placed on the discharge side 20B. The ordinate axis represent the voltage U(mV) across the electrodes 29A and 29B of the PZT resonator 28 and the abscissa axis represents the time t(ms). The plot shows a series of peaks and valleys representing the intake and compression strokes of the pump 21. The negative excursions correspond to the intake (vacuum) stroke of the compressor pump 21 while the positive excursions (pressure) correspond to the compression stroke. As shown by the two dotted vertical lines and double arrows in FIG. 3, two adjacent peaks are spaced apart by about 17.64 ms. This corresponds to pump's main frequency of about 56.69 Hz. During a compression stroke (positive excursion) there is a sustained pressure within the intake port 22. This suggests that as the piston in the pump 21 rises within the cylinder, a certain amount of air/gas reverses through the intake valve 21A. At some point the intake valve 21A closes, thus trapping compressed air within the intake side 20A. This suggests that the intake path 23C offers a certain amount of restriction to reverse flow because otherwise the pressure would not be expected to build up in this manner. Also, the accumulation of pressure on the intake side 20A suggests that it might assist with the intake valve 21A opening on subsequent intake strokes. That is, by pressurizing the intake during the compression stroke, and releasing that pressure during the subsequent intake stroke, it may be possible to assist with the operation of the intake valve 21A. This may be helpful in the type of pumps used in compressor systems since valves 21A and 21B in the pump 21 open and close in response to the movement of air across the valves and not due to any direct mechanical linkage.

Figure 4:
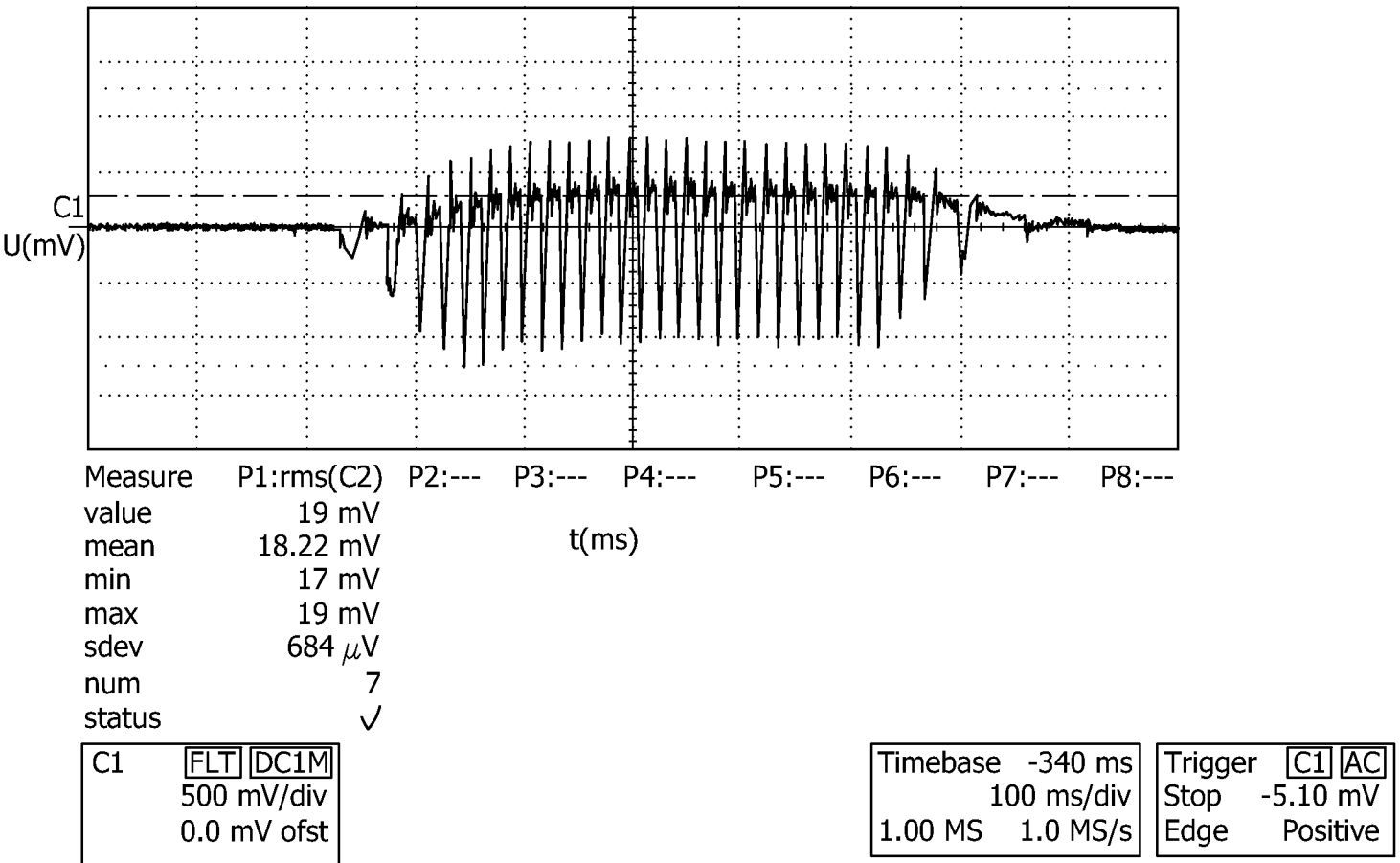
FIG. 4 is a plot of an electrical signal response of a PZT acoustic resonator when installed on the intake side of the compressor system depicted in FIG. 2.

FIG. 4 is a plot of an electrical signal response of the PZT acoustic resonator when installed on the intake side 20A of the compressor system 20 (as depicted in FIG. 2). The ordinate axis represent the voltage U(mV) across the electrodes of the PZT resonator and the abscissa axis represents the time t(ms). This plot illustrates the accumulation of pressure within the intake system 20A during a brief (less than about 1 second) power up cycle. Indeed, as shown in FIG. 4, the intake pressure (which manifests as a voltage across the electrodes of the PZT resonator) rises from zero and levels off (as shown by the dotted line in FIG. 4) within the first 10 pump cycles (approximately 0.3 second) after power up.

Figure 5:
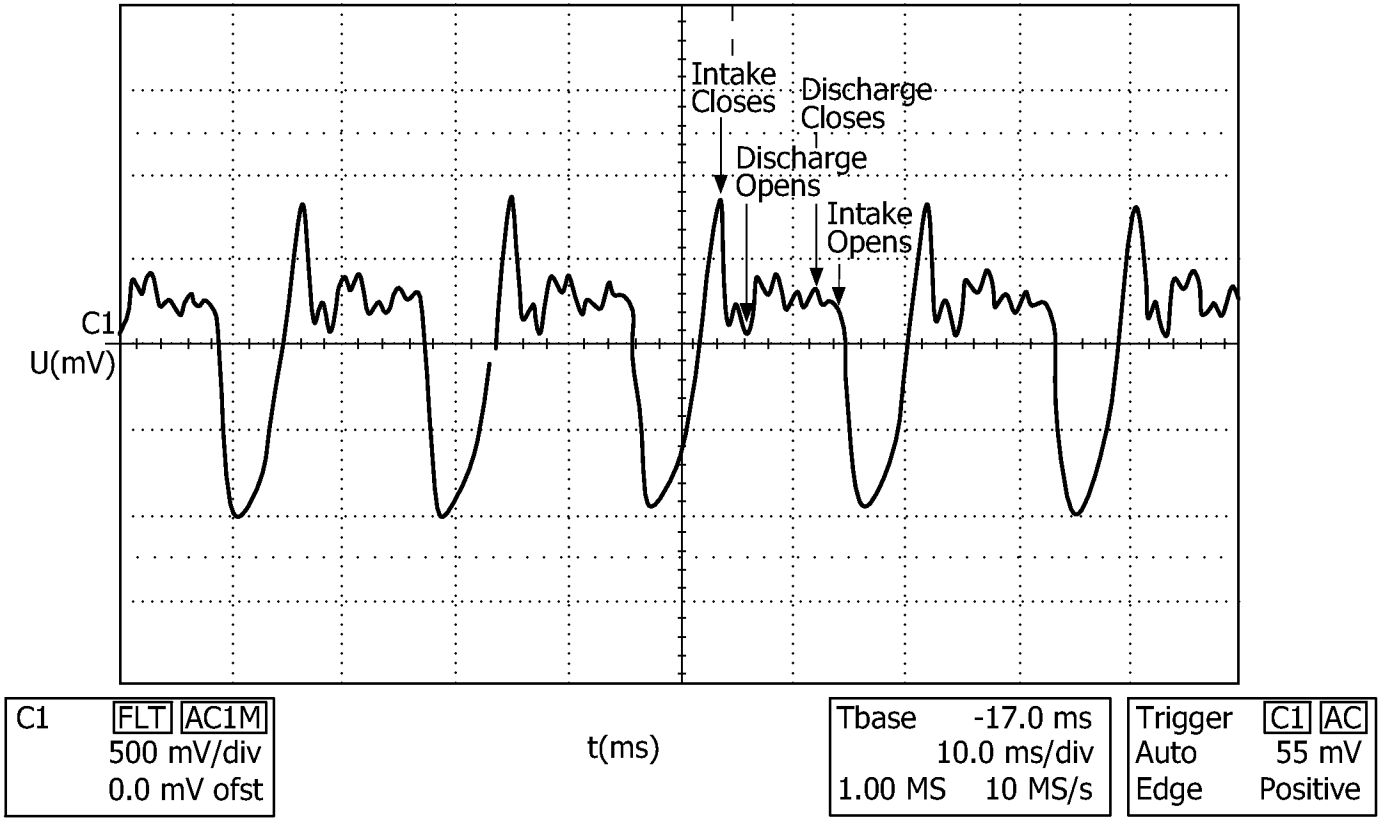
FIG. 5 is plot of an electrical signal response of a PZT acoustic resonator when installed on the intake side of the compressor system depicted in FIG. 2 using an orifice to establish an operating pressure of about 10 psi on the discharge side.

FIG. 5 is a plot of an electrical signal response of the PZT acoustic resonator 28 when installed on the intake side 20A of the compressor system 20 (as depicted in FIG. 2) using an orifice 25 to establish an operating pressure of about 10 psi on the discharge side 20B, i.e., at the output port 24 of the compressor system 20. The ordinate axis represent the voltage U(mV) across the electrodes 29A and 29B of the PZT resonator 28 and the abscissa axis represents the time t(ms). The plot shows a series of peaks and valleys representing the intake and compression strokes of the pump 21. The various phases of the intake and discharge are indicated in FIG. 5. The negative excursions correspond to the intake (vacuum) stroke of the compressor pump 21 while the positive excursions (pressure) correspond to the compression stroke. Specifically, positive displacement indicates an increase in intake pressure and negative displacement indicates a decrease in intake pressure, or vacuum, since the pressure appears to be going negative. Because the resonator 28 is disposed on the intake side 20A, operation (i.e., opening and/or closing) of the intake valve 21A in the pump 21 can be identified in this plot. The opening of the intake valve 21A is shown as the maximum rising point of the peak (pressure build up) and the closing of the intake valve 21A is shown as the point where sudden drop in pressure occurs. Once the intake valve 21A closes, the discharge valve 21B is no longer in direct communication with the resonator 28. As a result, the discharge valve 21B operating points become less distinct. Indeed, the variation in pressure between the opening of the discharge and closing of the discharge are less pronounced.

Figure 6:
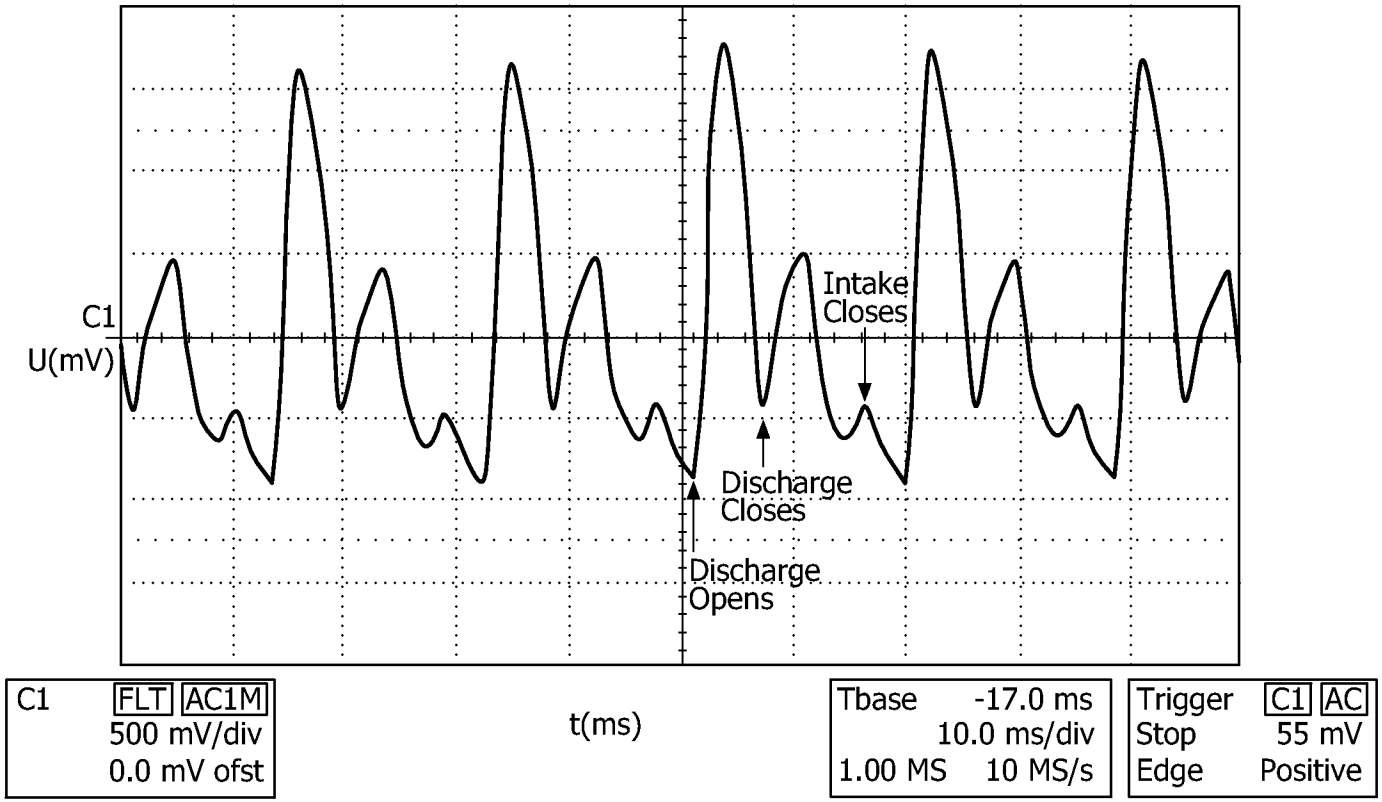
FIG. 6 is plot of an electrical signal response of a PZT acoustic resonator when installed on the discharge side of the compressor system depicted in FIG. 2 using an orifice to establish an operating pressure of about 10 psi on the discharge side.

FIG. 6 is a plot of an electrical signal response of the PZT acoustic resonator 28 when installed on the discharge side 20B of the compressor system 20 shown in FIG. 2A using an orifice 25 to establish an operating pressure of about 10 psi on the discharge side 20B, i.e., at the output port 24 of the compressor system 20. The ordinate axis represent the voltage U(mV) across the electrodes 29A, 29B of the PZT resonator 28 and the abscissa axis represents the time t(ms). The plot shows a series of peaks and valleys representing the opening of the discharge valve 21B, closing of the discharge valve 21B and closing of the intake valve 21A. In this case, positive displacement indicates an increase in discharge pressure and negative displacement indicates a decrease in discharge pressure. Since the resonator is now on the discharge side 20B, operation of the discharge valve 21B can be identified, as indicated. However, once the discharge valve 21B closes, the intake valve 21A is no longer in direct communication with the resonator 28. As a result, the opening of the intake valve 21A does not appear to be visible on the discharge side 20B.

It is worth noting that when the PZT resonator 28 is placed on the discharge side of the compressor system 20, reinforcement of the ceramic material 33 or the electrodes 29A, 29B used to form the PZT resonator 28 may be desirable. For example, a suitable backing material such as rubber can be used to protect the resonator 28.

Figure 7:
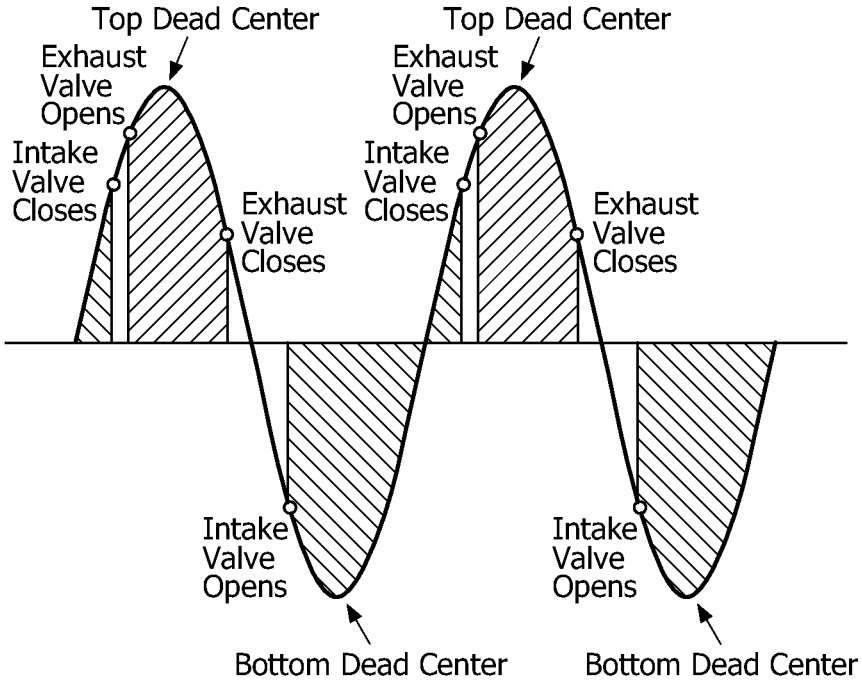
FIG. 7 shows the various opening and closing phases of the intake and exhaust valves during the operation cycle of a compressor pump, at a discharge pressure of about 10 psi.
Figure 8:
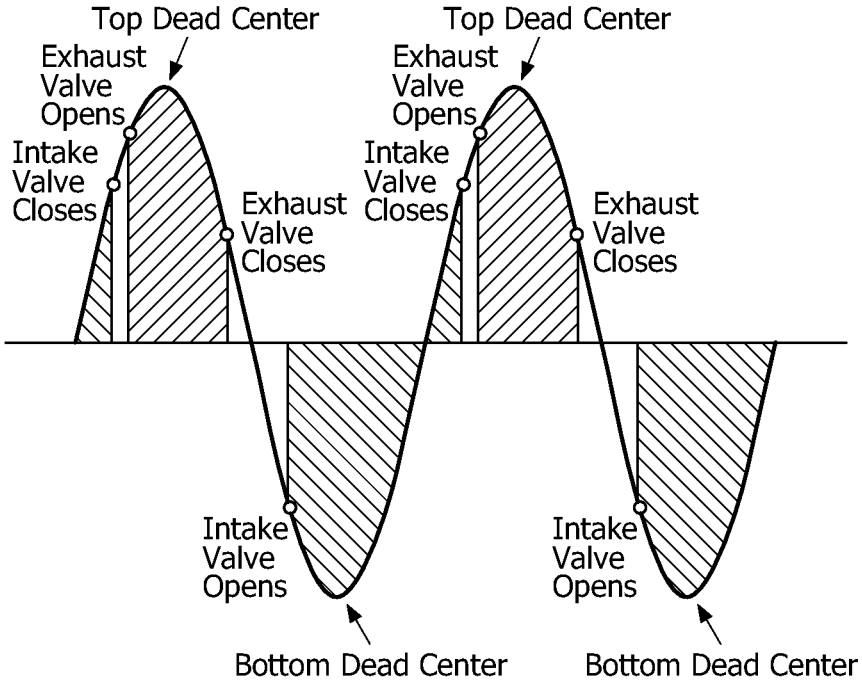
FIG. 8 show the various opening and closing phases of the intake and exhaust valves during the operation cycle of the compressor pump, at a discharge pressure of about 4 psi.

By capturing several such plots at different discharge pressures, it is possible to create a map of operation of intake valve 21A and discharge valve 21B within the cycle of operation of the pump 21. FIG. 7 shows the various opening and closing phases of the intake valve 21A and exhaust or discharge valve 21B during the operation cycle of the pump 21, at a discharge pressure of about 10 psi. FIG. 8 show the various opening and closing phases of the intake and exhaust valves 21A, 21B during the operation cycle of the pump 21, at a discharge pressure of about 4 psi.

As can be observed from FIGS. 7 and 8, the intake and exhaust valve closing points don't seem to be affected by pressure. Indeed, the intake valve 21A and the exhaust or discharge valve 21B are both closing at roughly the same point (respectively) in the pump cycle irrespective of the discharge operating pressure. In contrast, operating discharge pressure has a significant effect on the opening points of these two valves 21A and 21B (i.e., the intake valve and the discharge valve). In general, it appears from FIGS. 7 and 8 that higher pressures delay the opening of both valves 21A, 21B while lower pressures hasten their opening. Because the closing points of the intake and exhaust valves 21A, 21B appear to be unaffected by pressure, this means that both valves are open for less time at higher pressures. This information may be useful in certain situations. For example, if nebulizer operation were to cause changes in operating pressure, as might happen when using a "valved" nebulizer that reacts to patient breathing, it may be possible to detect such breathing at the opposite end of the nebulizer tubing, for example within the pump housing itself. A detailed description of an example of a valved nebulizer can be found in U.S. Pat. No. 5,062,419 entitled "Nebulizer with Valved "T" Assembly," the content of which is incorporated herein in its entirety by reference. Furthermore, if a suitable controller for controlling the compressor is provided, it may be possible to throttle the air delivered to the nebulizer (or patient) in concert with the patient's breathing cycle. An example of a suitable controller for controlling a compressor can be found in U.S. Pat. No. 6,681,767 entitled "Method and Device for Delivering Aerosolized Medicaments," the content of which is incorporated herein in its entirety by reference. It would then be possible to monitor patient breathing rates, identify tubing kinks, and provide sputter detection, all by means of such remote monitoring.

Another observation that can be made is how the intake valve opens as the piston approaches bottom dead center and remains open nearly ¾ of the way back to top dead center. This seems to confirm the earlier observation that some of the air or gas that enters the cylinder through the intake valve 21A exits the same way until the intake valve 21A closes. At that point, i.e., when the intake valve 21A closes, a certain amount of pressurized air becomes trapped within the intake system 20A and available to the next intake cycle.

Although a PZT type resonator is described in the above embodiments as being used as muffler for reducing or eliminating noise in a compressor system, instead of a resonator made of PZT material, a resonator fabricated from plastic, metal or various composite materials can be provided and used for attenuating or eliminating noise. In addition, different portions of the resonator 28 can be made from different materials. For example, the housing 29 can be made from metal while the neck 31 can be made from plastic, or the housing 29 can be made from one type of plastic (e.g., polycarbonate, acrylic, etc.) while the neck be made from another type of plastic (e.g., polypropylene, polyethylene, etc.). For example, the dimensions of the PZT resonator version can be used as a blueprint to fabricate a plastic muffler. In one embodiment, the resonator 28 has the following dimensions: the internal diameter of a cylindrical cavity 30 is about 24 mm, the height of the cylindrical cavity 30 is about 14 mm, the diameter of a cylindrical neck 31 is about 4.4 mm and the length of the cylindrical neck 31 is about 8 mm. However, as it can be appreciated the resonator can have other shapes and/or dimensions. Similar noise attenuation and/or noise elimination characteristics as the PZT resonator 28 can be observed using the muffler made of plastic.

Figure 9A:
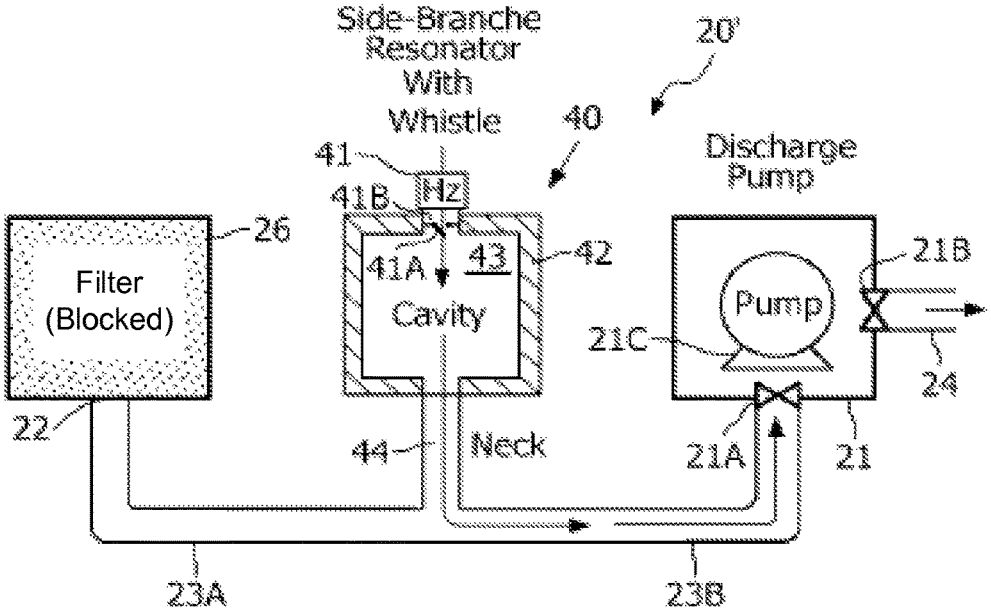
FIG. 9A is a pneumatic schematic block diagram of a compressor system using a side-branch muffler (resonator), according to another embodiment of the present invention.

FIG. 9A is a pneumatic schematic block diagram of a compressor system 20' using a side-branch muffler 40, according to another embodiment of the present invention. The compressor system 20' is similar in many aspects to the compressor system 20. Therefore, the description of similar components will not be repeated. The main difference between the compressor system 20 and the compressor system 20' is the use of a side-branch resonator or muffler 40 which incorporates an audible alarm device (e.g., a whistle) 41. The side-branch resonator 40 has a housing 42 defining a cavity 43. Similar to the muffler 28, the muffler 40 also includes an elongated member or neck 44. The cavity 43 communicates with audible alarm (e.g., whistle) 41. The audible alarm 41 can be either external to or integral to the resonator housing 42. A valve 41A is provided to isolate the whistle 41 from the cavity 43. The valve 41A is disposed in an opening 41B in the housing 42. The valve 41A is a one-way valve (e.g. a flap valve) that is configured to open only when air is introduced into the cavity 43 through the whistle 41, i.e., when the pressure inside the cavity 43 is less than the pressure outside the cavity 43. When the pressure inside the cavity 43 is equal or greater than the pressure outside the cavity 43, the valve 41A does not open to let gas and/or air in the cavity 43 escape to the exterior of the cavity 43.

If the filter 26 is clogged, the compressor pump 21 draws air from the cavity 43 which causes air to enter through the whistle 41 and thus open the valve 41A, thus providing an audible indication that filter 26 is clogged alerting the user for replacement of the filter 26. In some instances users will not replace their filters, either because it is inconvenient, or the users don't know when to do so. By providing an audible alert that tells the operator when to replace the filter 26 this will maintain a proper operation of the compressor system 20'. The valve 41A opens only when the filter 26 is sufficiently occluded, thus preventing the whistle 41 from activating with a good filter. In one embodiment, a piece of material similar to the cork (or other material) used in police whistles can be inserted into the whistle 41 as a modulator to modulate the whistle 41. This can give the whistle a distinctive "warbling" tone. In another embodiment, another approach for modulating the sound of the whistle 41 is to take advantage of the approximately 60 Hz pressure pulses seen in the earlier illustrations. At those pressures when the flap valve 41A is about to open, thus causing the whistle 41 to activate, the approximately 60 Hz pressure pulses would alternately open and close the one-way valve 41A, thus imparting a 60 Hz modulation to the sound.

In another embodiment, instead of using the whistle 41, the housing 42 of the resonator 40 can be used to form a whistle or an audible indicator. In this manner, the resonator 40 would act as both a noise reducer as well as a noise generator, depending on the state of the one-way valve 41A. When the filter 26 is not blocked or obstructed (clogged), the pressure inside the cavity 43 is greater than or equal to the pressure outside the cavity 43. As a result, the one-way valve 41A is closed and the resonator 40 operates to reduce or eliminate the noise generated by the compressor pump 21. When the filter 26 becomes clogged to a certain extent, the pressure inside the cavity 43 becomes less than the pressure outside the cavity 43. As a result, the one-way valve 41A opens to let air/gas penetrate into the cavity 43, hence bypassing the resonator 40. As a result, the resonator 40 does not operate to reduce noise which can be heard by the user thus alerting the user of the blocked or clogged state of the filter 26. This implementation can have the benefit of simple design without the addition of a whistle thus minimizing the overall cost of the compressor system 20'.

Figure 9B:
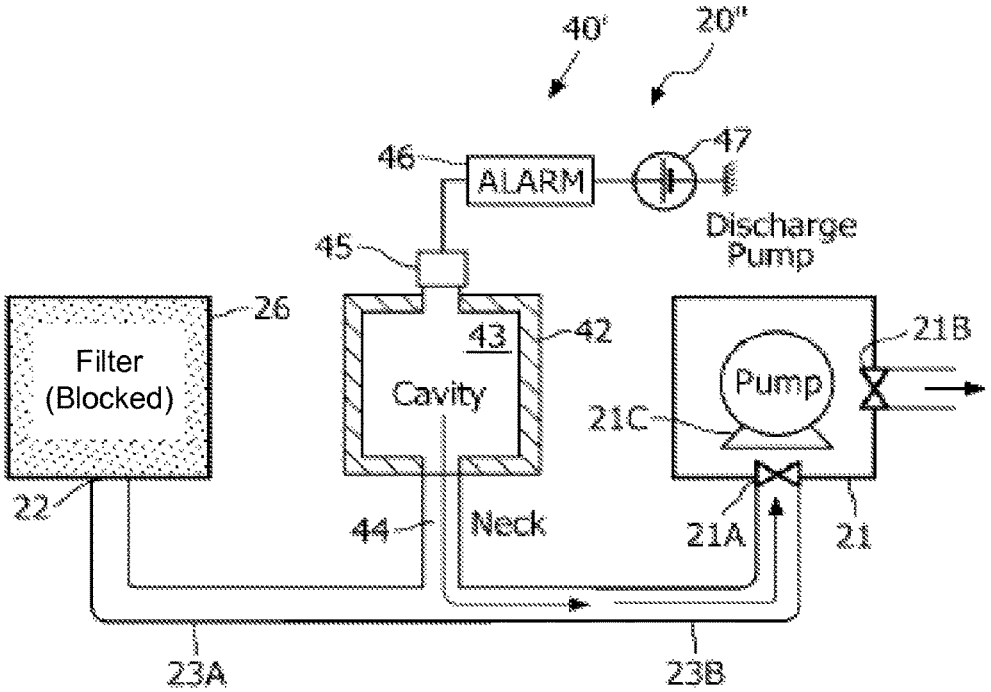
FIG. 9B is a pneumatic schematic block diagram of a compressor system using a side-branch muffler (resonator), according to yet another embodiment of the present invention.

FIG. 9B is a pneumatic schematic block diagram of a compressor system 20" using a side-branch muffler 40', according to yet another embodiment of the present invention. The compressor system 20" is similar in many aspects to the compressor system 20'. In this embodiment, a switch 45 (e.g., a pressure switch or mechanical switch) can be used to control an active alarm 46, either audible, visual (e.g. LED) or both. For example, when the pressure inside the cavity 43 drops bellow a certain threshold pressure, the switch 45 activates the audible alarm 46 to emit a sound or activates the visual alarm 46 to emit light, or both, to alert the user that the filter 26 is "blocked." In this embodiment, however, the active alarm 46 may need a source of power 47 to energize the alarm 46. For example, in a DC compressor, this can be accomplished by using the DC power source used to power the compressor. Alternatively, a small battery, such as a coin-shaped cell battery, that can power either the audible or visual alarm 46, or both can be incorporated within the resonator housing. A coin-shaped cell battery (e.g., lithium) or a lithium ion battery can provide years of service, especially in such applications where the power of the battery is only used infrequently.

Additional variations to the above described embodiments can take advantage of the air flowing into the cavity from the outside and may include such concepts are spinning wheels, fans and clappers to generate noise. Of course, regardless of the implementation chosen, with the valve in the closed position the side-branch resonator would perform its primary purpose of reducing audible pump noise with minimal effect on air flow.

Figure 10:
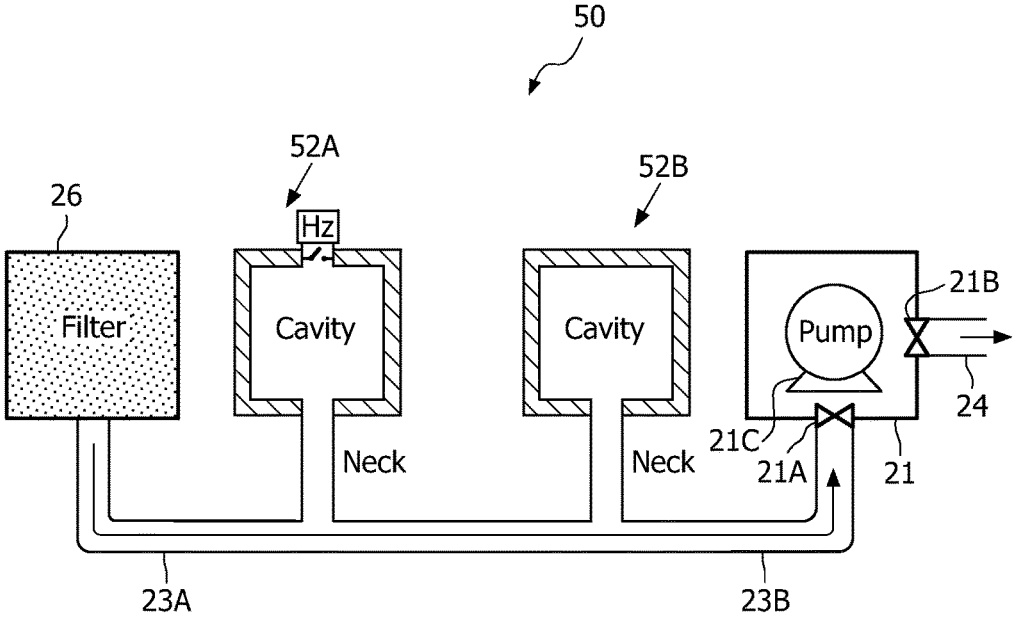
FIG. 10 is a pneumatic schematic block diagram of a compressor system using a plurality of side-branch mufflers (resonators), according to another embodiment of the present invention.

FIG. 10 is a pneumatic schematic block diagram of a compressor system 50 using a plurality of side-branch mufflers (resonators), according to another embodiment of the present invention. The compressor system 50 is similar in many aspects to the compressor system 20, 20'. Therefore, the description of similar components will not be repeated. The main difference between the compressor system 20, 20' and the compressor system 50 is the use of a plurality of side-branch resonators or muffler 52A, 52B. Mufflers 52A and 52B can have the same construction as muffler 28 or muffler 40. In one embodiment, the resonator 52A can be configured to eliminate noise in a certain frequency range while resonator 52B can be used to eliminate noise in another frequency range. The use of a plurality of resonators 52A and 52B tuned to different frequency ranges allows one to tailor the resonators 52A and 52B such that the sum of the frequency ranges substantially covers the frequency spectrum of the noise generated by the compressor 21 to substantially reduce or eliminate the noise generated by the compressor pump 21. Although two resonators 52A and 52B are depicted in FIG. 10 connected to the line 23A, 23B, as it can be appreciated any number of resonators can be connected to the line 23A, 23B.

Figure 11:
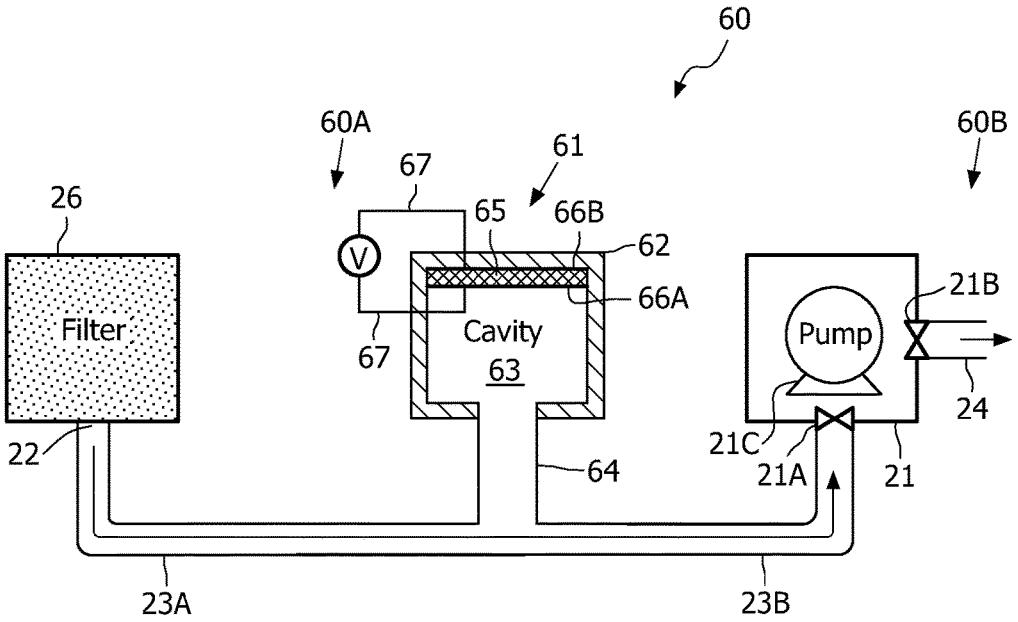
FIG. 11 is a pneumatic schematic block diagram of a compressor system using a side-branch resonator, according to yet another embodiment of the present invention.

FIG. 11 is a pneumatic schematic block diagram of a compressor system 60 using a side-branch resonator 61, according to yet another embodiment of the present invention. The compressor system 60 is similar in many aspects to the compressor system 20, 20'. Therefore, the description of similar components will not be repeated. The main difference between the compressor system 20, 20' and the compressor system 60 is the use of a different side-branch resonator 61. The side-branch resonator 61 has a housing 62 defining a cavity 63. The resonator 61 also includes an elongated member or neck 64. In one embodiment, the resonator 61 is connected to a pneumatic line 23A, 23B connecting the compressor pump 21 to the inlet port 22, as described in detail above with respect to the resonator 28. Therefore, the resonator 61 has many of the features described above in the resonator 28. In one embodiment, the housing 62 of the resonator 61 is constructed of a material such as plastic. The resonator 61 further includes a piezoelectric material 65 such as a PZT material. The PZT material 65 is disposed or sandwiched between two electrode plates 66A and 66B. Wires 67 can be attached to the electrodes (e.g., silver electrodes) 66A and 66B to observe the voltage output by the PZT material 65 via a voltage measuring device V, such as an oscilloscope, for example. This allows monitoring the resonance performance during operation of the resonator 61 and hence monitoring the opening and/or closing of intake valve 21A and discharge valve 21B in the compressor pump 21, as described in detail in the above paragraphs. In one embodiment, the resonator can be disposed in the cavity 63 against a wall of the housing 62, for example attached to a wall of the housing 62. This configuration of the resonator 61 can be used to reduce noise generated by the compressor pump 21, to monitor an operation of the compressor pump 21 (e.g., to monitor the opening and/or closing of the valves 21A, 21B), or both.

As depicted in FIG. 11, the resonator 61 is connected on the intake side 60A of the compressor system 60. However, as it can be appreciated, the resonator 61 can be connected on the discharge side 60B of the compressor system 60. In fact, the configuration of the resonator 61 is well suited to be connected on the discharge side 60B without the need of protecting the piezoelectric material 65 and/or the electrodes 66A, 66B from the relatively higher pressure at the discharge side 20B. The wall of the housing 62 can provide support and thus protection for the piezoelectric material 65 and/or electrodes 66A and 66B against possible damage.

Although the invention has been described in detail for the purpose of illustration based on what is currently considered to be the most practical and preferred embodiments, it is to be understood that such detail is solely for that purpose and that the invention is not limited to the disclosed embodiments, but, on the contrary, is intended to cover modifications and equivalent arrangements that are within the spirit and scope of the appended claims. For example, it is to be understood that the present invention contemplates that, to the extent possible, one or more features of any embodiment can be combined with one or more features of any other embodiment.

The invention claimed is:

1. A method of monitoring a compressor pump in operation in a compressor nebulizer system, the method comprising:

disposing a side-branch resonator in the compressor nebulizer system, the side-branch resonator having:

a housing forming a cavity the housing comprising a one-way valve, the one-way valve being disposed in a first opening of the housing; the one-way valve configured to close when a pressure inside the cavity is greater than a pressure outside the cavity and to open when a pressure inside the cavity is less than a pressure outside the cavity; and an elongated member connected to a second opening of the housing, the second opening being different from the first opening wherein the housing comprises a piezoelectric material;

connecting pneumatically the elongated member to a pneumatic line linking between an inlet port of the compressor nebulizer system and the compressor pump of the compressor nebulizer system;

pressurizing gas input through the inlet port and output through an outlet port of the compressor nebulizer system; and monitoring an operation of the compressor pump using the side-branch resonator.

2. The method of claim 1, wherein monitoring the operation of the compressor pump comprises monitoring an opening or closing, or both, of an intake valve or a discharge valve, or both in the compressor pump during a cycle of operation of the compressor pump.

3. The method of claim 1, wherein the piezoelectric material comprises lead zirconate titanate.

4. A method of reducing noise in a compressor nebulizer system, comprising:

disposing a side-branch resonator in the compressor nebulizer system, the side-branch resonator having:

a housing forming a cavity, the housing comprising a one-way valve, the one-way valve being disposed in a first opening of the housing; the one-way valve configured to close when a pressure inside the cavity is greater than a pressure outside the cavity and to open when a pressure inside the cavity is less than a pressure outside the cavity; and an elongated member connected to a second opening of the housing, the second opening being different from the first opening, wherein the housing comprises a piezoelectric material;

connecting pneumatically the elongated member to a pneumatic line linking between an inlet port of the compressor nebulizer system and a compressor pump of the compressor nebulizer system;

pressurizing gas input through the inlet port and output through an outlet port of the compressor nebulizer system; and tuning a frequency range of the side-branch resonator so as to substantially reduce noise generated by the compressor pump.

5. The method of claim 4, wherein tuning comprises selecting a volume of the cavity, selecting a length of the elongated member, selecting a cross-sectional dimension of the elongated member, or any combination of two or more thereof.

6. A compressor system comprising:

an inlet port configured to receive gas;

an outlet port configured to output compressed gas;

a compressor pump connected to the inlet port via a pneumatic line and to the outlet port, the compressor pump being configured to pressurize gas input through the inlet port and output a compressed gas through the outlet port, the compressor pump generating noise during operation of the compressor pump; and a side-branch resonator having:

a housing forming a cavity, the housing comprising a one-way valve, the one-way valve being disposed in a first opening of the housing; the one-way valve configured to close when a pressure inside the cavity is greater than a pressure outside the cavity and to open when a pressure inside the cavity is less than a pressure outside the cavity; and an elongated member connected to a second opening of the housing, the second opening being different from the first opening and the elongated member being pneumatically connected to the pneumatic line between the inlet port and the compressor pump, wherein the side-branch resonator is configured to substantially reduce noise generated by the compressor pump, and wherein the housing of the side-branch resonator comprises a piezoelectric material, wherein flow of gas within the pneumatic line connecting the compressor pump and the inlet port is substantially unimpeded by the side-branch.

7. The compressor system of claim 6, further comprising a filter connected to the inlet port.

8. The compressor system of claim 7, wherein the side-branch resonator is configured to alert a user when the filter is clogged.

9. The compressor system of claim 6, wherein a volume of the cavity, a length of the elongated member, a cross-sectional dimension of the elongated member, or any combination of two or more thereof is selected so as to substantially reduce the noise generated by the compressor pump.

10. The compressor system of claim 6, wherein the side-branch resonator is fabricated from materials selected from the group consisting of ceramics, plastics, metal, and composites.

11. The compressor system of claim 10, wherein the housing of side-branch resonator is made from one material and the elongated member of the side-branch resonator is made from another material.

12. The compressor system of claim 6, wherein the piezoelectric material comprises lead zirconate titanate.

13. The compressor system of claim 6, wherein the piezoelectric material is disposed inside the cavity against a wall of the housing of the side-branch resonator.

14. The compressor system of claim 6, wherein the side-branch resonator is configured to further monitor the operation of the compressor system.

15. The compressor system of claim 14, wherein the compressor pump comprises an intake valve and a discharge valve, wherein the side-branch resonator is configured to detect the opening or closing, or both, of the intake valve or the discharge valve, or both within a cycle of operation of the compressor pump.

16. The compressor system of claim 15, wherein closing points of the intake valve and the discharge valve are not affected by the discharge operating pressure.

17. The compressor system of claim 6, wherein the side-branch resonator is tuned to attenuate noise in a frequency range emitted by the compressor pump.

18. The compressor system of claim 6, wherein the side-branch resonator further comprises a first side-branch resonator and a second side-branch resonator, wherein the first side-branch resonator is tuned to a first frequency range and the second side-branch resonator is tuned to a second frequency range different from the first frequency such that the sum of the first frequency range and the second frequency range substantially covers a frequency spectrum of noise generated by the compressor pump.

19. The compressor system of claim 6, wherein the side-branch resonator is configured to alert a user when the inlet port is obstructed.

20. The compressor system of claim 6, wherein the pressure inside the cavity is greater than or equal to the pressure outside the cavity when a flow of gas through the inlet port is substantially unobstructed and the pressure inside the cavity is less than the pressure outside the cavity when the flow of gas through the inlet port is substantially obstructed.

21. The compressor system of claim 20, wherein when the one-way valve closes the side-branch resonator operates as a noise muffler to reduce the noise emitted by the compressor pump and when the one-way valve opens the side-branch resonator ceases to operate as a noise muffler alerting a user of the compressor system that the inlet port is substantially obstructed.

22. The compressor system of claim 6, further comprising an audible alarm device disposed in communication with the opening in the cavity and isolated from the cavity by the one-way valve.

23. The compressor system of claim 22, wherein the pressure inside the cavity is greater than or equal to the pressure outside the cavity when a flow of gas through the inlet port is substantially unobstructed and the pressure inside the cavity is less than the pressure outside the cavity when the flow of gas through the inlet port is substantially obstructed.

24. The compressor system of claim 23, wherein when the one-way valve closes, the side-branch resonator operates as a noise muffler to reduce the noise emitted by the compressor pump and when the one-way valve opens, the side-branch resonator ceases to operate as a noise muffler and gas penetrates into the cavity through the audible alarm device which sounds an alarm to alert a user that the inlet port is substantially obstructed.

* * * * *